United States Patent [19]

Takeda et al.

[11] 4,400,582

[45] Aug. 23, 1983

[54] SPEECH SYNTHESIZER

[75] Inventors: Koji Takeda; Masao Akahane; Chitoshi Takayama, all of Suwa, Japan

[73] Assignee: Kabushiki, Kaisha Suwa Seikosha, Tokyo, Japan

[21] Appl. No.: 267,280

[22] Filed: May 27, 1981

[30] Foreign Application Priority Data

| | | | |
|---|---|---|---|
| May 27, 1980 | [JP] | Japan | 55-70613 |
| May 29, 1980 | [JP] | Japan | 55-72025 |
| May 29, 1980 | [JP] | Japan | 55-72026 |
| Sep. 25, 1980 | [JP] | Japan | 55-133298 |
| Oct. 14, 1980 | [JP] | Japan | 55-143157 |

[51] Int. Cl.[3] ..... G10L 1/00

[52] U.S. Cl. ..... 179/1 SM; 364/513

[58] Field of Search ..... 179/1 SM, 1 SG, 1 SA; 364/513

[56] References Cited

U.S. PATENT DOCUMENTS

| | | | |
|---|---|---|---|
| 3,641,496 | 2/1972 | Slavin | 179/1 SM |
| 4,163,120 | 7/1979 | Baumwolspiner | 179/1 SM |
| 4,214,125 | 7/1980 | Mozer | 179/1 SM |

OTHER PUBLICATIONS

Richard Wiggins and Larry Brantingham, Texas Instruments Inc., Dallas; Three-Chip System Synthesizes Human Speech; Electronics, Aug. 31, 1978, pp.109-116.

*Primary Examiner*—Emanuel S. Kemeny

*Attorney, Agent, or Firm*—Blum, Kaplan, Friedman, Silberman & Beran

[57] ABSTRACT

Storage space in this speech synthesizer is minimized by features including multiplex storage of voiceless phonemes and use of a word designator which selects in parallel information from a word memory and phoneme memory.

20 Claims, 19 Drawing Figures

FIG. 1
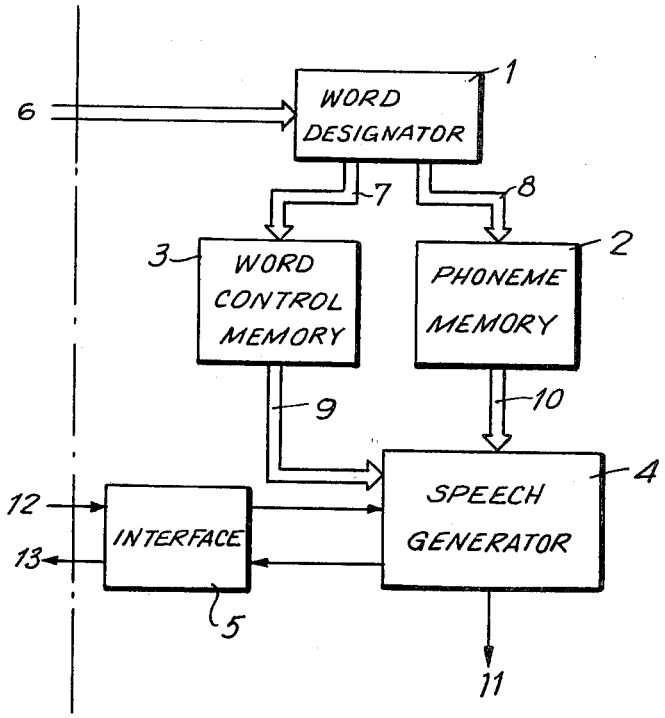
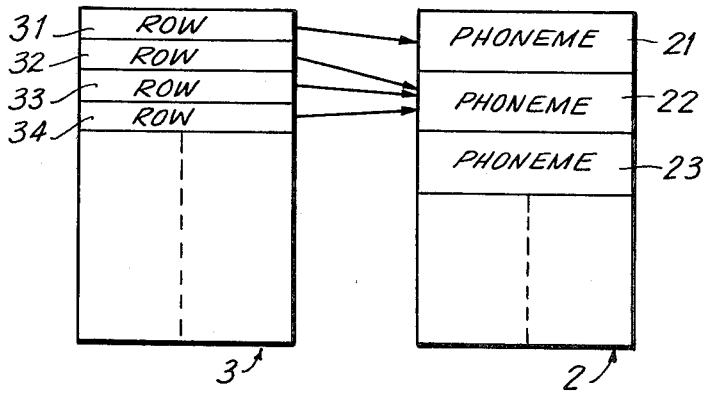
FIG. 3

SPEECH SYNTHESIZER

BACKGROUND OF THE INVENTION

This invention relates generally to a speech synthesizer reproducing speech by the joining together in sequence a plurality of phonemes, and more particularly to a speech synthesizer where the phonemes and the control instructions for outputting the phonemes in the proper sequence are stored in separate memories. In a speech synthesizing system, typical speech elements are selected and stored as waveform data from the natural speech of humans in pitches, that is, intervals or periods of repetition, as voiced phonemes for voiced sounds having periodicity. Voiceless sounds having no periodicity are also selected from human speech as voiceless phonemes and stored. Alternatively, portions of the voiceless sounds are used repetitively as voiceless phonemes. The voiced and voiceless phonemes are stored in separate voiced phoneme and voiceless phoneme memories respectively, and then read-out and coupled together in accordance with externally provided control information. Thereby, speech is synthesized. The externally provided control information comprises instructions as to whether a phoneme is voiced or voiceless, phoneme numbers, amplitudes, pitches, repetition numbers, and the like. With such a speech synthesizing system, typical voiced and voiceless phonemes of a language are all recorded as representative phonemes. Those phonemes which are most analogous to the natural speech and language which is to be reproduced are successively selected and coupled together to generate a desired word. In other words, phonemes are selected from an inventory of voiced and voiceless phonemes which are typical of a given language.

However, the quality of speech as synthesized by such a system has proved unsatisfactory because the representative typical phonemes which constitute the synthesized speech are extracted from words which are most frequently different from the actual words which are to be produced from memory by joining phonemes together. In actual applications where a synthesized message is produced, words are usually generated in groups ranging from several words to a few more than ten words. The interval of time to deliver such a synthesized message is in the order of ten seconds. Thus, ability to generate any and all words on demand is not always necessary, as a fixed message is frequently all that is required.

Also, storage of the voiced phonemes and the voiceless phonemes in separate memories is not desirable from the standpoint of assembling a speech synthesizer in a one-chip integrated circuit. Because the ratio in the size of the voiced and voiceless phoneme memories to be used varies with the actual words to be stored, an unused area frequently remains in one of the memories which makes it impossible to put the memories to truly efficient use. Further, the use of two phoneme memories complicates the control circuitry.

What is needed is a speech synthesizer using a single memory for storing both voiced and voiceless phonemes in an efficient manner. It is also desirable that the synthesized speech accurately represent the words and language which is spoken.

SUMMARY OF THE INVENTION

Generally speaking, in accordance with the invention, a speech synthesizer especially suitable for efficient utilization of phoneme memory and for production in single-chip integrated circuitry is provided. The speech synthesizer comprises a first memory for storing phonemes and a second memory storing control information for reading out phonemes, so as to output words from a speech generator and loudspeaker in a sequence to form a "spoken" message. Phonemes, voiced and voiceless, are stored in the same memory and in memory regions of fixed dimension arranged in the time sequence of natural speech. Phoneme memory space is efficiently utilized by allocating, in some instances, less space for voiceless phonemes than for voiced phonemes. The control memory stores information of amplitude, pitch, repetition, etc., for the phonemes in the order of phoneme output. An interface with an exterior device is provided to initiate speech but speech, once begun, synthesis is internally controlled by instructions in the control memory. Multiplex storage of voiceless phonemes is used to further reduce memory requirements. In an alternative embodiment, words are synthesized from an inventory of words stored in memory as phonemes and selected in a preferred order by instructions in the control memory. Digital outputs from phoneme memory are converted to analog signals for audible reproduction.

Accordingly, it is an object of this invention to provide an improved speech synthesizer which efficiently stores voiced and voiceless phoneme data in a single memory.

Another object of this invention is to provide an improved speech synthesizer which is produced on a single chip integrated circuit.

Still another object of this invention is to provide an improved speech synthesizer which internally controls the production of a voiced message.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a functional block diagram of a speech synthesizer in accordance with this invention;

FIG. 3 is a functional diagram indicating the relationship between control and phoneme memories;

DESCRIPTION OF THE PREFERRED EMBODIMENTS

With reference to FIG. 1, a phoneme memory 2, which stores voiced and voiceless phonemes, comprises a read-only memory (ROM) and an address counter for indicating addresses within the memory 2. In this embodiment, one sampling point for a phoneme is expressed in six bits. When one phoneme is represented by forty points, the phoneme comprises $6\times40=240$ bits. If the total number of phonemes to be stored is N, the size of the read-only memory becomes $6\times(40\times N)$. Thus, a memory region for a phoneme has a size of 240 bits in the embodiment of FIG. 1.

When using a sampling frequency of 10 khz, one phoneme of 40 points has a duration of 4 milliseconds with the points occurring at regular time intervals. This value of 4 milliseconds is selected in consideration that women have a pitch of voiced sounds which average on the order of 4 milliseconds. As discussed more fully hereinafter, the word "pitch" represents the interval or period of time after which a phoneme pattern is repeated. With males, the pitch is about 8 milliseconds and hence, one phoneme would be composed of 80 points. Whereas the following description is directed to the synthesis of female speech, it is applicable as well to male speech except for the number of points for each phoneme. The numerical values used in the descriptions are illustrative and should not be interpreted as limitations.

Figure 2A:
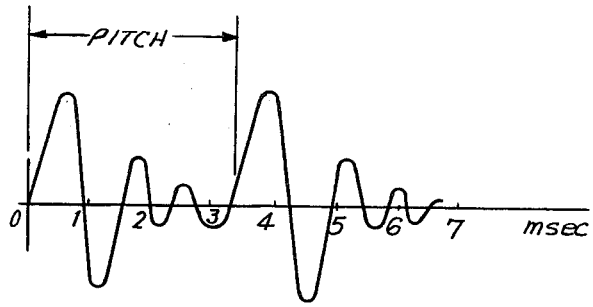
FIGS. 2*a–e* presents waveforms indicating the storage in memory of voiced phonemes.
Figure 2B:
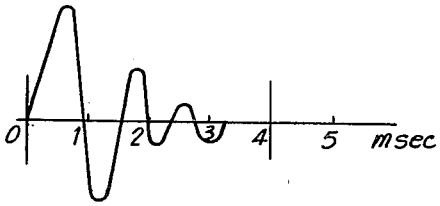

FIG. 2*a* illustrates a phoneme having a pitch of approximately 3.3 milliseconds. In storing such a phoneme in memory providing a 4 millisecond storage, a 0, that is, a zero level, is added after the phoneme so that the voiced phoneme is recorded, that is, stored as shown in FIG. 2*b* in 4 milliseconds.

Figure 2C:
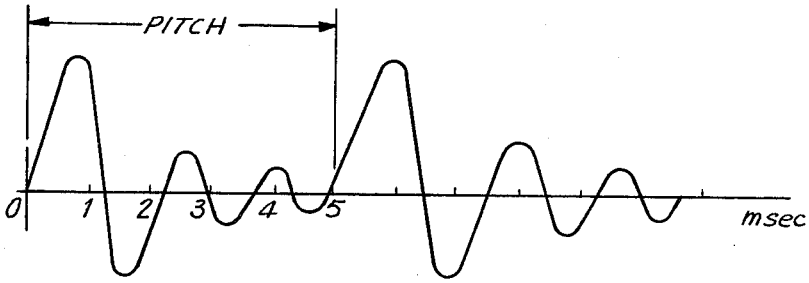
Figure 2D:
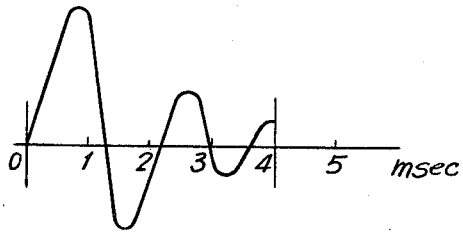
Figure 2E:
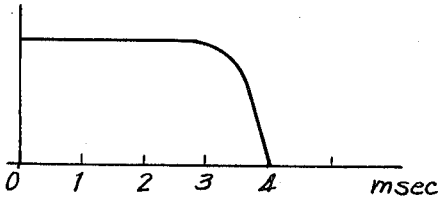
Figure 2F:
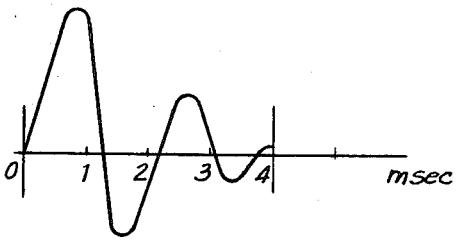
Figure 4A:
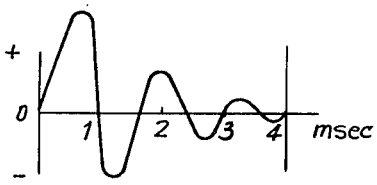
FIGS. 4*a–d* present waveforms indicating synthesized waveforms of phonemes stored in memory.
Figure 4B:
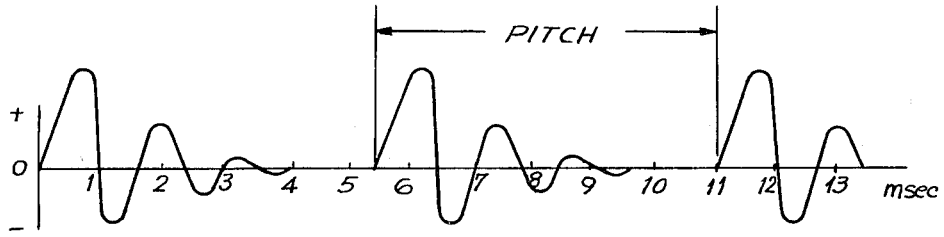
Figure 4C:
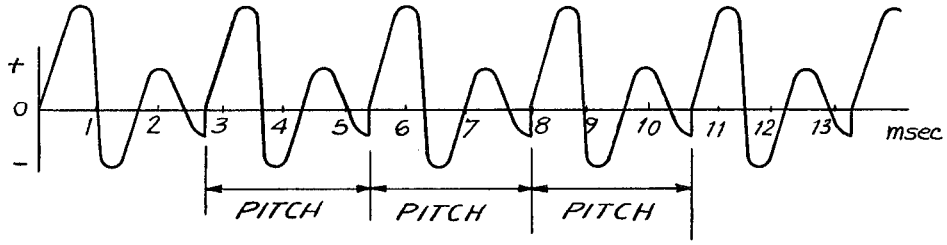
Figure 4D:
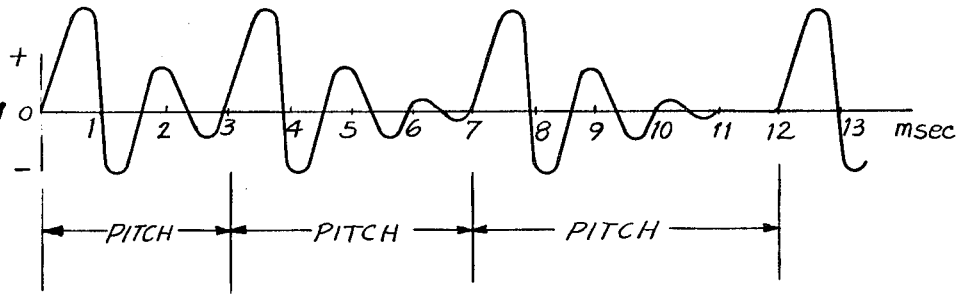

FIG. 2*c* illustrates a phoneme having a pitch of approximately 5 seconds. In storing such a phoneme in memory, the phoneme is cut off in 4 milliseconds and is stored in memory, that is, recorded as shown in FIG. 2*d*. A weighting function, which gradually approaches zero in the vicinity of the end of the phoneme at 4 milliseconds, is shown in FIG. 2*e*. This weighting function when multiplied with the signal of FIG. 2*d* produces the phoneme waveform for storage as illustrated in FIG. 2*f*. This phoneme (2*f*) is contained within the 4 millisecond memory space suitable for 40 points, and ends at approximately the zero level as does the original 5 millisecond phoneme. Voiceless sounds which have a pitch greater than 4 milliseconds are divided at every 4 millisecond period and they are recorded successively as a plurality of phonemes. All of these phonemes are recorded in the read-only memory in the time sequence of the natural speech without concern over the distinction between the voiced and voiceless phonemes.

As an example, when two Japanese phrases, "ohayou gozaimasu" which means "good morning" in English, and "oyasumi nasai", which means "good night" in English, are to be recorded, voiced phonemes necessary for synthesizing "o" are first picked up from natural speech and recorded. Then the first voiceless region of "ha" is picked up and recorded as voiceless phonemes. Similarly, the remaining phonemes are recorded in the order occurring in the phrase "ohayou gozaimasu" without concern over distinction between voiced and voiceless phonemes. Thereafter, phonemes are stored to synthesize the phrase "oyasumi nasai".

A word control memory 3, which stores control information necessary to synthesize speech from the phonemes stored in the phoneme memory 2, comprises an address counter and a read-only memroy (ROM). One control unit in the memory 3, hereinafter referred to as a row, is comprised of amplitude, pitch, and repetition number data, which serve as control information for one phoneme. The row and phoneme correspond to each other in order, in accordance with the order of arrangement of the ROMS in the phoneme memory 2 and word control memory 3. However, the first, second, third, etc., row does not necessarily correspond to the first, second, third, etc., phoneme, respectively, but a plurality of successive rows may correspond to one phoneme. Such a construction is described with reference to FIG. 3. Wherein control units or rows 31–34 are indicated in the word control memory 3, and phonemes 21,22,23, comprising 240 bits each are indicated in the phoneme memory 2.

The row 31 corresponds with the phoneme 21, and the row 32 corresponds to the phoneme 22, however, the row 33 also corresponds to the phoneme 22 rather than to the phoneme 23. Similarly, row 34 corresponds with instructions to the phoneme 22. Such a relationship of correspondence occurs when it is desired, for example, to repeat the same phoneme with the amplitude of pitch of one phoneme varying gradually. Therefore, the control unit contains information as to whether the control information is for the phoneme corresponding to a previous row or for the next phoneme. The control unit also contains information indicative of the ending of one unit of synthesis, for example, a sentence. Provided that the row which contains information indicating the ending of a sentence is called the final row, then the groups of rows corresponding to the sentences "ohayou gozaimasu" and "oyasumi nasai" have respective final rows. The number of final rows agrees with the number of sentences or phrases that can be generated.

With reference to FIG. 1, a speech generator 4 synthesizes and generates output speech signals based on the phoneme data 10 in bits fed one point at a time from the phoneme memory 2. The speech generator 4 supplies a driving signal 11 to a loudspeaker by way of an digital/analog converter (not shown). Signal lines 6 provide external signals indicative of the number of the sentence or phrase which it is desired to generate. Where the signal lines 6 are five in number, up to 32 words or sentences can be designated based upon a binary selection. A word designator 1, comprises a read-only memory for designating the starting address for the word control memory 3 and the starting address for the phoneme memory 2 with respect to the word or sentence selected by the information on the signal line 6. A signal line 12 actuates the speech generator 4 through an interface 5. A signal line 13 indicates when a synthesized sentence has been completed.

In operation, when the number identifying a sentence to be generated is set on the signal lines 6, the speech generator 4 is energized by a signal on the signal line 12. Simultaneously the starting address for the word control memory 3 and the starting address for the phoneme memory 2 are selected in the internal address counters through the signal line 7,8 respectively. The starting addresses are for the word, sentence or phrase selected on the signal lines 6. The address counter within the word control memory 3 counts up rows by increments of one, each time a phoneme corresponding to each row is fed as an output to the speech generator 4 in accordance with the control information. This continues until the final row is reached. The address counter in the phoneme memory 2 may or may not be counted up at each count in the control memory depending on the control information for each row in the word control memory 3 as stated above. When the address counter in the word control memory 3 counts up to enable speech synthesis to progress until the final row is reached, the speech synthesis is brought to an end, and the ending is signaled externally via the signal line 13. The speech synthesis is interrupted until another actuation is provided through the signal lines 6,12.

As described above, with the speech synthesizer in accordance with this invention, voiced and voiceless phonemes that have been extracted from natural speech are indescriminately recorded in the order of occurrence in phoneme memory regions of the same size in the same ROM so that the read-only memory for phonemes is put to effective use. This efficiency is achieved because separated voiced and voiceless phoneme memories are subject to a fixed ratio in the space usage between them, whereas a single memory has an entirely variable ratio in the quantities of each type of phonemes which can be stored. With the regions for storage of voiced and voiceless phonemes being of the same size, the control circuitry for the speech synthesizer is greatly simplified.

Because the phonemes are extracted from natural speech and recorded, that is, stored in the time sequence in which they occur, tone quality is greatly improved, although the period of time for generation of a synthesized speech is not long. In actual applications, however, the period of time for speech generation suffices when it is a range from several to several more than ten seconds. Tone quality plays a vital role in most situations. Accordingly, a speech synthesized in accordance with this invention is acceptable for practical applications where good quality of tone is required but the message duration is not long. A plurality of rows in the word control memory 3 can correspond and control the same phoneme, such that control where pitch and amplitude are finely adjusted is possible for the one phoneme. Hence, speech of high tone quality can be synthesized with a relatively small number of stored phonemes. With the arrangement of the phoneme memory and the word control memory as described above, tone quality (compressive ratio) and the time interval for speech generation can be modified freely by a fine-to-rough manner of registration of phonemes. More specifically, when a long time period for speech generation is desired, with poorer tone qualities, phonemes can be extracted roughly. On the other hand, when better tone quality is desired and the interval of time for speech is short, phonemes can be extracted finely. Such control is possible merely with variations in the content of the control ROM.

The speech synthesized in accordance with this invention, is assembled on a single chip integrated circuit and has the following advantages. First, the speech synthesizer is composed principally of ROMS with the number of other controllable parts being minimized. Thus, an inexpensive speech synthesizer IC is provided for applications in which an interval of time for speech generation ranges from several seconds to several seconds more than ten seconds. Secondly, the speech synthesizer operates as a single integrated circuit. More specifically, a construction as shown in FIG. 1 is actuated simply by setting the number of a sentence which is required to be outputted on the signals lines 6 and applying an energizing pulse to the signal line 12. Therefore, attachment of an actuator switch to such a construction as shown in FIG. 1 produces an entire speech synthesizer. A third advantage is that the speech synthesizer is easily interfaced with other devices such as a microcomputer. Such simple interfacing is made possible by the signal line 13, indicative of the condition of operation of the synthesizer, signal line 6 indicating the number of the sentence to be synthesized, and the signal line 12 for application of an energizing pulse. It should be readily understood that a plurality of integrated circuit chips as in FIG. 1 can be connected in parallel for use in synthesizers producing high quality output sound as well as a long time interval message. The use of a plurality of integrated circuit chips is accomplished with the addition of a chip-select signal which selects or addresses one particular integrated circuit chip while not selecting the other integrated circuit chips.

By using the signals on the signal line 13, a series of connected words can be generated. More specifically, and as an example, an announcement of time is described wherein "tadaimanojikokuwa 2 ji 10 pundesu" is to be generated by the speech synthesizer. This Japanese sentence means "it is 2:10" in English. The Japanese to be generated is broken down into "tadaimanojikokuwa", "2", "ji", "10", and "pundesu" which are each stored as a word comprised of many phonemes. Then, "tadaimanojikokuwa" is generated first. When a signal on the signal line 13 indicates that the first word has been completely generated, "2" is generated. Similarly, "ji", "10", and "pundesu" are successively generated. To announce a desired time, integers from "1" to "60" are prepared and stored in memory as phonemes in addition to "tadaimanojikokuwa", "ji", and "pundesu". Since the speech synthesizer can generate a series of connected words, it is useful in applications where common words are used in many combinations such as indicated above where it is possible to indicate the time for every hour and minute of the day.

If the phoneme memory regions had been sized for phonemes of six milliseconds, then it is obvious that many of the regions would be only partially filled, and the space wasted as compared to the memory described above which is based on a four millisecond phoneme. In accordance with this information, the stored phonemes are connected and reproduced merely in accordance with the pitch information given at the time of storage with the result that the pitches of the connected voiced sounds are in conformity with the pitches of the voiced sounds when they are recorded, as described hereinafter. As a voiced phoneme changes, the pitches also change discretely. Where a difference in pitch between two successive voiced phonemes during speech synthesis is large, the change in pitch greatly affects intonation. When intonation is abruptly (coarsely) changed, deterioration in the quality of synthesized speech is great. In order to eliminate such a defect in output, there are methods to extract representative phonemes finely in that portion of speech where the pitch changes abruptly. Such an approach, however, requires a large sized phoneme memory and this is not desirable. In accordance with this invention, the disadvantages of abrupt change in tone quality is overcome by producing improved output speech waveforms while at the same time achieving a phoneme memory as described above which is small in size. As stated, the storage regions are based on the average pitch of female speech, that is, approximately four milliseconds. A maximum pitch for a women is in the order of six milliseconds.

Phoneme memory regions capable of storing waveforms of six milliseconds are able to reproduce phonemes completely, but this is not efficient storage in that most of the phonemes have a pitch in the order of four milliseconds which is near the average pitch. Constructing the phoneme memory regions for a pitch of six milliseconds is deemed unnecessary also due to the fact that the trailing portion of the phoneme waveform is less important than the leading portion of the phoneme waveform as it effects the quality of synthesized speech output. Thus, memory regions sized for four milliseconds average pitch are reasonable for female speech and provide a suitable example here. FIGS. *2a–e* indicate how all phonemes are recorded and stored in a four millisecond pitch, corresponding to the average pitch of the phonemes in female speech. Thereby, the phoneme memory 2 is reduced to about $\frac{2}{3}$ of the size which would be required for full reproduction of the phonemes up to six milliseconds in duration. As arranged, the empty areas in the phoneme memory regions are significantly decreased and there is no deterioration in the quality of the synthesized speech.

The concept for storing phonemes in a fixed four millisecond region has been described. The concepts for reading out phonemes from the phoneme memory 2 for synthesizing speech in accordance with this invention is now described with reference to FIGS. *4a–d*. FIG. *4a* illustrates a phoneme stored in a four millisecond region of memory. When the time interval designated by a pitch control signal from the word control memory 3 is longer than the time interval of four milliseconds, the entire phoneme of four milliseconds is first read-out. For example, if the phoneme at the time of recording was actually 5.5 milliseconds and the signal has been compressed to four milliseconds, the phoneme as recorded in four milliseconds is read-out. Then a fixed value, that is, a zero signal, is added at the end of the four milliseconds for a period of 1.5 milliseconds. Then, the next phoneme which is to be connected is read-out of memory. Thus, the elapsed time between the start of the first phoneme and the start of the second phoneme is 5.5 milliseconds, just as it was when the phoneme was originally recorded. The pitch has been restored to 5.5 milliseconds as a whole although there is some distortion at the very trailing edge of the phoneme which does not affect the sound quality.

On the other hand, when the time interval designated by the pitch control signal from the word control memory 3 indicates that the phoneme should have a pitch less than four milliseconds, for example, 2.7 milliseconds, the entire phoneme is not read-out but the output is cut off at the occurrence of a pitch control signal, that is, at 2.7 milliseconds. This is illustrated in FIG. *4c*. The next phoneme which is to be connected is then read-out. In this way, repetitive waveforms having a pitch of 2.7 milliseconds can be synthesized from a four millisecond storage region.

As stated above, the end or trailing portion of a phoneme is of less consequence with respect to tone quality than the leading portion. Hence, quality of the synthesized waveforms *4b,c* is only slightly deteriorated.

With this means for controlling the pitch of a phoneme by the insertion of a fixed value or cutting off time, one phoneme can be read-out at many desired pitches. Therefore, when two phonemes to be connected are largely different from each other only in pitch at the time of extraction from memory for each synthesis, no new phoneme is required and the pitch of one phoneme can be varied gradually. FIG. *4d* shows an example wherein the phoneme of FIG. *4a* is read-out, gradually changing the pitch from three milliseconds to four milliseconds to five milliseconds.

Figure 5:
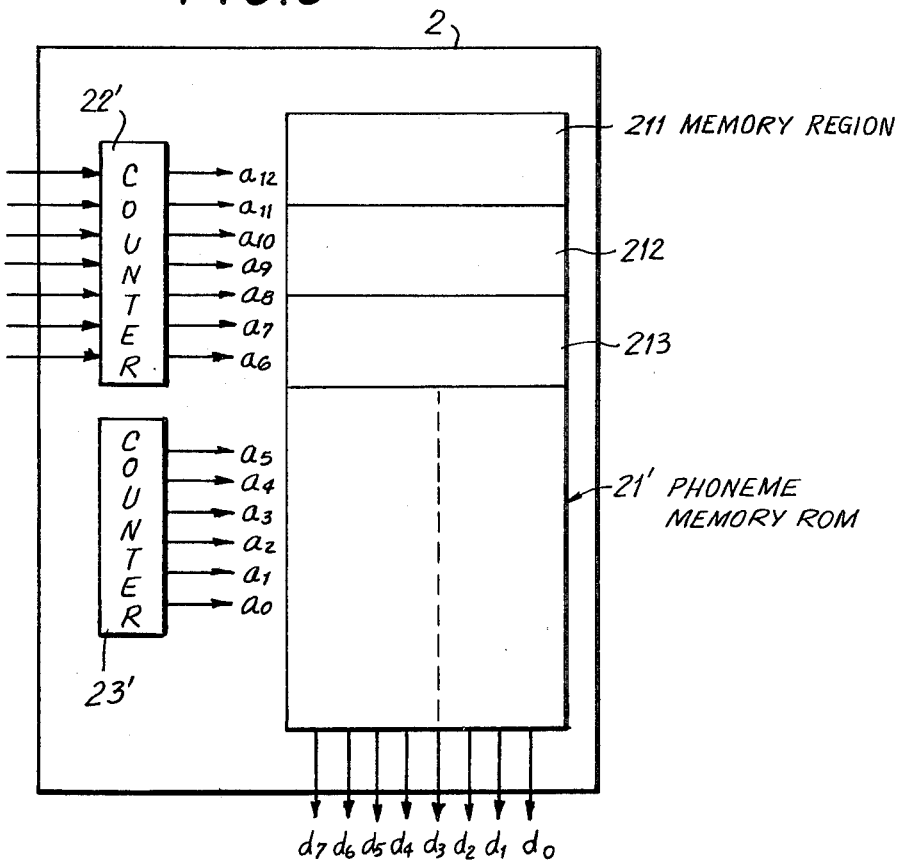
FIG. 5 is a functional block diagram of a phoneme memory in accordance with this invention.

An alternative construction of the phoneme memory 2 of FIG. 1 is shown in FIG. 5, wherein a read-only memory 21' comprises a plurality of phoneme memory regions 211–13, and a phoneme number counter 22' for designating the number of the phoneme. The counter 22' comprises a presettable counter of seven bits which can process a maximum of 128 phonemes. Naturally, the number of the bits in the counter 22' can be modified in accordance with the number of phonemes which are stored. An address counter 23' indicates the position of the data in the phonemes. Where the phoneme memory 2 stores female speech phonemes having an average pitch of approximately 4 milliseconds and a maximum pitch of approximately 6 milliseconds when reproduced, and with a sampling frequency of 10 L khz, and with the number of bits in the data position address counter 23' being 6, a phoneme having an interval of 6.3 milliseconds is addressable, since $(2^6-1)\times 0.1$ msec. $=6.3$ msec. Such an interval is greater than the assumed 6 msec. maximum pitch, and hence, is sufficient. Phoneme memory regions 211–213 each store a phoneme for four milliseconds and composed of $8\times 40=320$ bits with each of forty sampling points being expressed in eight bits. Each phoneme memory region has phoneme numbers which are designated by the phoneme number counter 22' ($a_6$ to $a_{12}$). Forty points of data in each phoneme memory region are assigned addresses from 0 to 39 successively from above. The addresses are designated by the position designating address counter 23' ($a_0$ to $a_5$). Since the position designating counter 23' has six bits, addresses from 0 to 63 can be designated. However, no ROM regions exist for the addresses of 40 to 63 as there are only 40 points in a stored phoneme, and the read-only memory 21' is arranged such that the output lines $d_0$ to $d_7$ provide a low or zero output when those addresses are selected.

The phoneme memory 2, constructed as in FIG. 5, can perform the functions described with reference to FIGS. *4a–d*. More specifically, when the number of a phoneme to be read-out of memory is set in the phoneme number counter 22', and a pitch P is designated therein, the position designating address counter 23 is reset and counts up in increments of 0.1 milliseconds, that is, a 10 khz sampling rate, until the output of the address counter 23' is in agreement with the pitch time P. Thereupon, the address counter 23' is reset again. This is because the pitch time P is maximum at 60 (6 milliseconds), and when the position designating address counter 23' is counting in the range from 40 to 63, the output from the ROM 21' is 0 as stated above. Thus, a pitch range of output phonemes is 0.1 to 6.0 msec.

Thus, a construction for recording and synthesizing speech is described above where it is possible to synthesize speech with little deterioration of tone quality with fine control of the pitch of the same phoneme even when representative intermediate phonemes are not recorded. This is accomplished using relatively small phoneme memory regions. The construction is simple and uses only a small amount of hardware for performing the functions of the invention.

In the construction described above, the interval of time in which one voiceless phoneme is generated can be the same as that in which one voiced phoneme is generated. As an example, when a one voiced phoneme is stored as data in an interval of 4 milliseconds, a time interval in which one voiceless phoneme can be generated is also 4 milliseconds. Therefore, storage of a voiceless sound having an interval of 40 milliseconds requires divisions of the sound into phonemes of 4 milliseconds which are stored in ten phoneme memory regions. Generally, the duration of voiced sounds ranges from several to 10 milliseconds. On the other hand, voiceless sounds have a duration range from several tens to several hundreds of milliseconds. The synthesizer described above is not the most suitable for generation of sentences having a greater ratio of voiceless sounds to voiced sounds since much memory must be devoted to storing the extended voiceless phonemes. An alternative embodiment eliminates the disadvantage inherent in equal memory sizes for voiced and voiceless phonemes by providing means for increasing the density of storage of voiceless sounds such that the interval of time in which speech is generated from a given phoneme memory region is lengthened.

Figure 6:
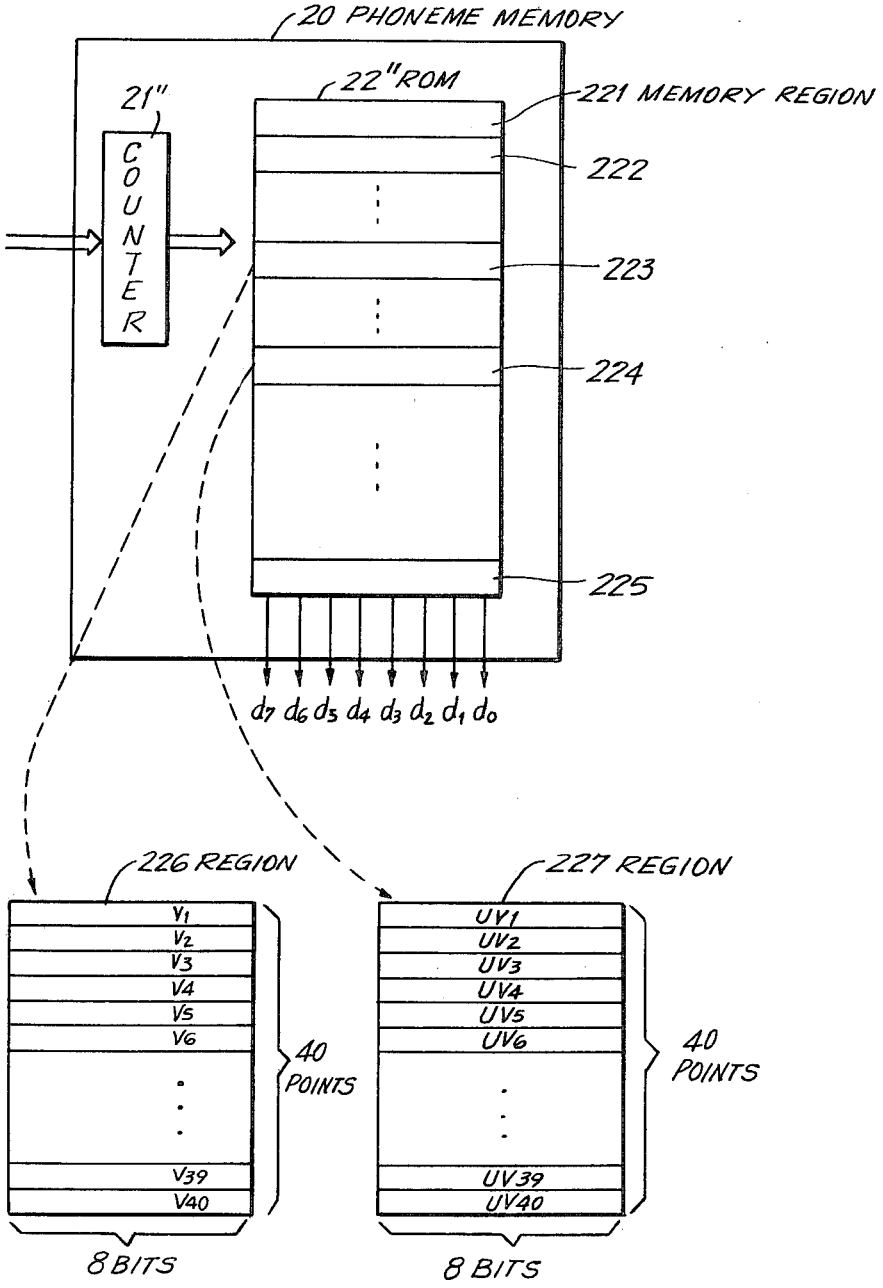
FIG. 6 is similar to FIG. 5 showing a phoneme memory in greater detail.

Again the description which follows is based on female speech having an average pitch in the order of milliseconds, although the synthesizer in accordance with this invention is not limited to female speech. This alternative embodiment is directed to an improvement in the structure of the phoneme memory 2 of FIG. 1. One arrangement for the phoneme memory 2 of FIG. 1 is illustrated in FIG. 6 and given the reference numeral 20. The phoneme memory 20 comprises an address counter 21'' and a read-only memory 22'' having therein a multiplicity of phoneme memory regions 221–225 of the same dimension. Phoneme memory regions 226,227 are representative of regions which store voiced and voiceless phonemes respectively. V1 to V40 and UV' to UV40 correspond to the forty sampling points for the voiced and voiceless phonemes respectively. Each point is here quantized in eight bits d0–d7. Assuming that female speech having an average pitch of 4 milliseconds is to be processed at a sampling frequency of 10 khz, one voiced phoneme can be expressed as data of 4 msec$\times$10 khz=40 points. Thus, one phoneme memory region is constructed as $8\times40=320$ bits. Since such an arrangement stores both voiced and voiceless phonemes, the interval of time in which one voiceless phoneme can be generated is 4 milliseconds. This is an extremely short time for most voiceless sounds. Therefore, many phoneme memory regions are required for voiceless sounds which have an interval ranging from several tens to several hundreds of milliseconds, generally speaking.

Figure 7:
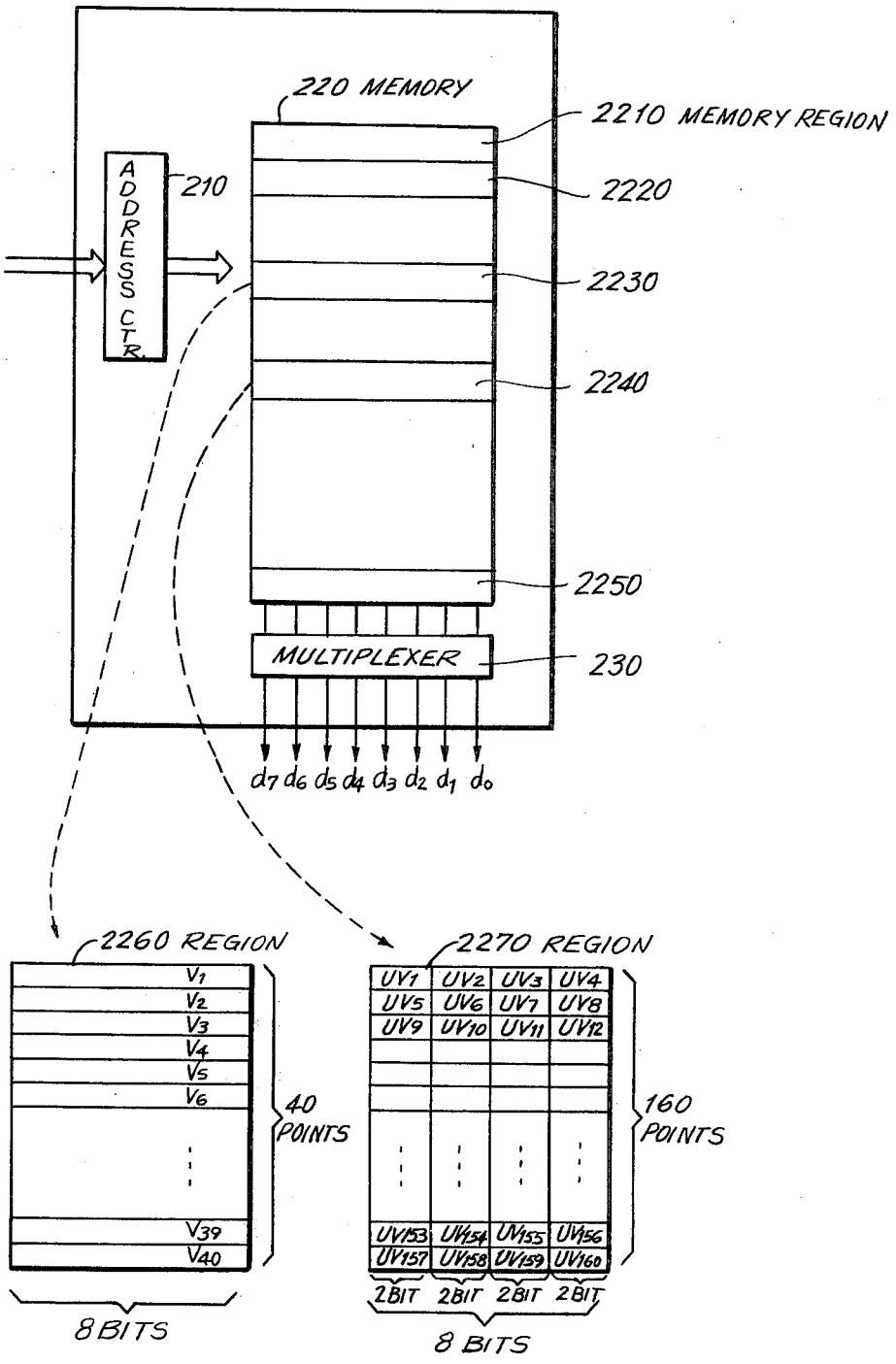
FIG. 7 is similar to FIG. 6 and shows an alternative embodiment of a phoneme memory in accordance with this invention.

The embodiment of the phoneme memory 220 of FIG. 7 eliminates the defficiencies of the foregoing memory (FIG. 6) by quantizing the voiceless phoneme with a lower number of bits and using multiplex storage of voiceless sounds. This approach is based on the fact that voiceless sounds are generally weaker in power than voiced sounds and can be quantized with 1 to 4 bits instead of the eight bits used for generating speech of good tone quality. In FIG. 7, the phoneme memory 220 includes an address counter 210, a ready-only memory 220. The phoneme memory region in the ROM 220 are identical in arrangement to those shown in FIG. 6, with the exception that voiceless phonemes are stored in phoneme memory regions in a different manner as shown in the representative voiceless memory region 2270 (FIG. 7). Since it has been found that voiceless sounds can be quantized in two bits without deterioration of tone quality, they are quantized at one sampling point in two bits for storage in memory. Thus, the number of bits for voiceless phonemes is ¼ of the number of bits for quantization of voice sounds. Thus, four points of voiceless sounds are stored where one point of voiced sound can be stored. For example, four points UV1 to UV4 in FIG. 7 are stored together in the section UV1 as shown in FIG. 6.

As compared to FIG. 6, wherein voiceless sounds are recorded only as forty points in 4 milliseconds, in one phoneme memory region of FIG. 7, there can be recorded four times as many, that is, 160 points which represent 16 milliseconds of time when the sound is reproduced. This is done with no appreciable deterioration of tone quality. The memory of FIG. 7 requires a multiplexer 230 for reading out the phonemes from the multiplex storage, four times, that is, two bits at a time from the left. The amount of hardware added for the multiplexer 230 is small.

While the voiceless sound has been shown to be quantized in two bits in the phoneme memory region 2270 (FIG. 7), multiplexing by two or more times is possible by quantizing a voiceless sound at a number of bits which is one-half or less of the number of bits for quantization of a voiced sound. As an example, quantization of a voiceless sound in three bits permits doubled storage. While a small unused memory portion is created, more precisely two bits per data point, and 80 bits per phoneme memory region, such a defect is small as compared with the gain resulting from multiple storage of FIG. 7. Therefore, the density of storage for voiceless sounds is greatly increased while minimizing deterioration of tone quality and at the same time holding the required additional circuitry to a minimum. Accordingly, more phonemes are stored in a phoneme memory 220 (FIG. 7) than in the construction of FIG. 6. The memories in both constructions are approximately of equal size but longer sentences can be synthesized from the construction of FIG. 7. Thus, the speech synthesizer with the multiplex storage of voiceless phonemes finds uses in many more applications.

In the embodiments described above, with relation to the synthesizer of FIG. 1, the phonemes are read out of memory in the order in which they are recorded. Speech is synthesized in the speech generator 4 and then is produced as an output speech signal on the line 13 fed ultimately to a loudspeaker (not shown). The end of the word is detected by information, indicative of the end, which occurs at the end of the group of control information. When the reading of the control information progresses to the ending position, speech synthesis is finished and a notice of completion is sent externally via a signal line 12, as described above.

The synthesizer of FIG. 1 is energizable by itself or by another control device (CPU or the like). Such an integrated circuit arrangement when operated by itself does not create any difficulties when dealing with expressions which are constituted of one word such as "ohayou" or "oyasumi". These single Japanese words means "good morning" or "good night" respectively, in English and constitute the entire message. However, where an expression is composed of two or more words such as "goyotei nojikandesu" or "kaigi nojikandesu", a word or words included in the expression are repetitive, such as "nojikandesu". This is redundant. It should be noted that the above Japanese expressions means "it is time for the appointed schedule" and "it is time to have a meeting", respectively. Under control of an external device such as a CPU, "goyotei" (appointed schedule), "kaigi" (meeting) and "nojikandesu" (it is time, etc.) are stored as separate words, which can later be put together in the different sentences, but having "nojikandesu" shared by the different sentences. In the embodiment described above, the word "nojikandesu" would be stored twice, which is redundant both with regard to the phoneme memory 2 and with regard to the performance of the word control memory 3. In an alternative embodiment in accordance with this invention, this disadvantage of redundancy is eliminated by adding information indicative of the next operation, hereinafter referred to as next information, to the end of the group of control information corresponding to "words" in the word control memory. Thus, there is incorporated another capability of putting words together in the speech synthesizer.

Figure 8:
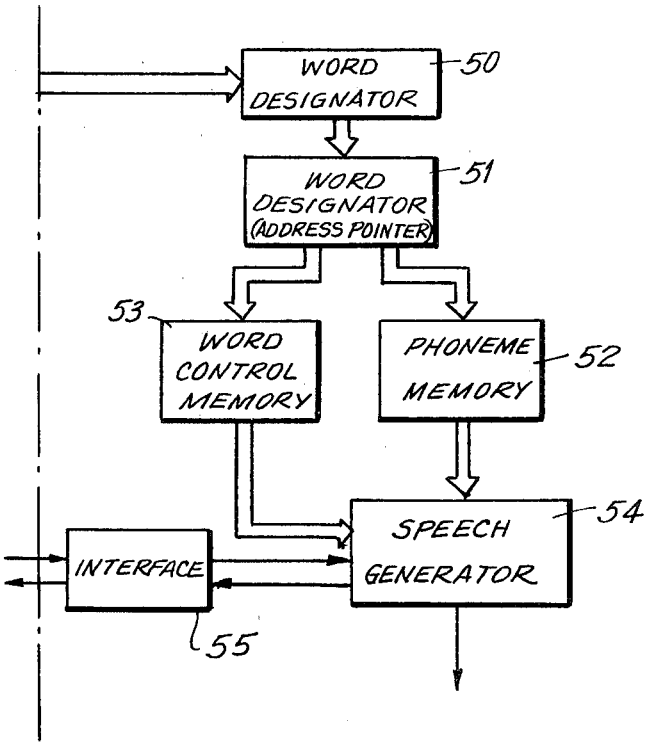
FIG. 8 is a modification of the functional block diagram of FIG. 1 including means for connecting words together.

Before proceeding with a description of the present invention, another less preferable alternative arrangement is first described. An arrangement which connects words in the speech synthesizer without control by an external device such as a CPU would use another word designator 50, (FIG. 8) for controlling the word designator 51 (word designator in FIG. 1) for indicating the order in which words are combined together, with all combinations for connecting words being stored therein. Otherwise, the configuration of FIG. 8 is the same as in FIG. 1. With such an arrangement, the read-only memory may become large in size where there are many combinations and the amount of hardware for overall circuit control may be increased. A speech synthesizer construction which avoids these difficulties is now described.

Figure 9:
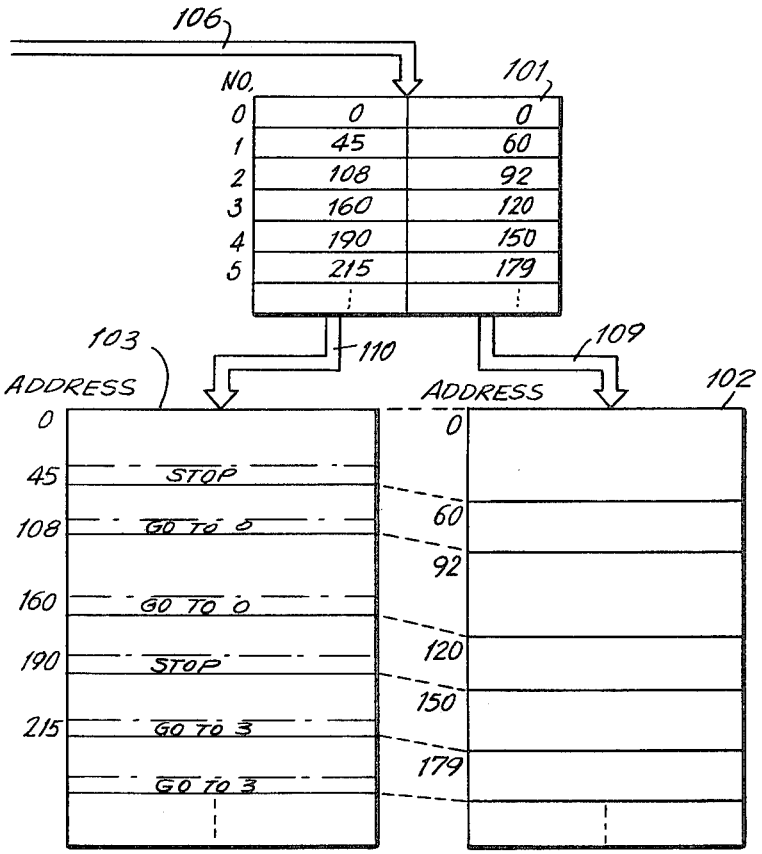
FIG. 9 is a functional block diagram indicating an alternative contruction for control of synthesis.

The speech synthesizer at FIG. 9 in accordance with this invention includes a word designator 101, a phoneme memory 102, and a word control memory 103 used in the manner and arrangement shown in FIG. 1 and corresponding to word designator 1, phoneme memory 2 and word control memory 3, respectively. Table 1 summarizes the operation of the circuit of FIG. 9. The speech synthesizer described here for the sake of an example outputs sounds in the Japanese language. Whereas single words are indicated in Japanese, it should be understood that their translations may include several words. Each Japanese word which the speech synthesizer is capable of producing, that is, the data as stored in the memories to produce such synthesized words, is assigned a number. The word designator 101 stores starting addresses for phonemes of "words" and control information associated with those phonemes as described above. For example, the word No. 3 corresponds to "mairimasu", and control information corresponding to word No. 3 is stored in the word control memory 103 starting at address 160. Phoneme point data bits corresponding to word No. 3 are stored in the phoneme memory 102 starting at address 120. The phoneme memory 102 is arranged as previously described where the phonemes are stored in regions in time sequence.

TABLE 1

| ENGLISH | WORD DESIGNATOR NO. | JAPANESE CONTENT | STARTING ADDRESS FOR WORD CONTROL MEMORY | STARTING ADDRESS FOR PHONEME MEMORY | NEXT INFORMATION |
|---|---|---|---|---|---|
| IT IS | 0 | NOJIKANDESU | 0 | 0 | STOP |
| TIME TO APPOINTED SCHEDULE | 1 | OYAKUSOKUNO | 45 | 60 | GO TO 0 |
| MEETING | 2 | KAIGINO | 108 | 92 | GO TO 0 |
| GO | 3 | MAIRIMASU | 160 | 120 | STOP |
| GO UP | 4 | UENI | 190 | 150 | GO TO 3 |
| GO DOWN | 5 | SHITANI | 215 | 179 | GO TO 3 |

However, in this alternative embodiment (FIG. 9) in accordance with this invention, the arrangement of information stored in the word control memory 103 is modified. Heretofore, as described above, stored information indicates the ending of a group of control information corresponding respectively to the "words". When such ending information is detected in the sequence of instructions, synthesis of speech is completed and terminates. Accordingly, no word connecting function has been provided in the word control function 3 of speech synthesizers described above. The phonemes are read out in the order of their storage until termination of synthesis. In the alternative embodiment of FIG. 9, a capability for designating the number of the next word which it is desired to synthesize is included as information data, that is, the next information, at the end of groups of control informations. This is in addition to the information which indicates the pitch, termination of speech synthesis, etc. Thus, it becomes possible to connect words together in the speech synthesizer without relying entirely on the sequence of storage. In FIG. 9, "nojikandesu" is designated at No. 0 with the next information being "stop". When the No. 0 is selected the word "nojikandesu" is synthesized and thereafter operation immediately stops. At No. 1 in the word designator 101 is stored the addresses related to the word "oyakusoku" with the next information being "go to 0". Therefore, generation of "oyakusoku" is followed immediately by generation of the word "nojikandesu" which is the word No. 0. Stated otherwise, when the word No. 1 is selected in the word designator 101 and the sythesizer is actuated, "oyakusoku nojikandesu" is produced. Parenthetically, it should be noted, that although the English equivalent appears to have an inverted construction, the sentence is properly pronounced in Japanese.

Figure 10:
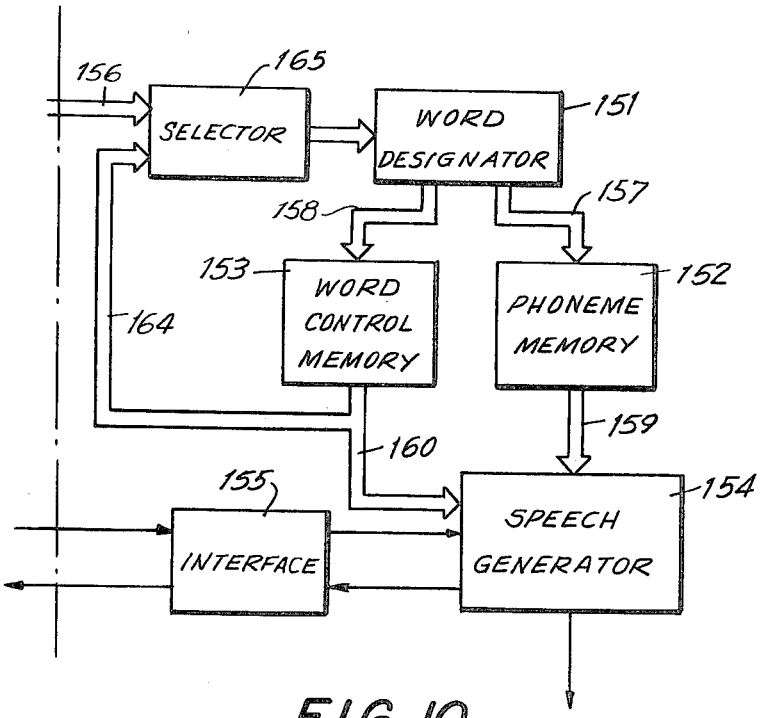
FIG. 10 is functional block diagram similar to FIG. 1 and adapted to use the control methods of FIG. 9.

Similarly, selection of Nos. 2,4, and 5 causes "kaigi nokikandesu", "ueni mairimasu", and "shitanimairimasu" to be generated, respectively. The step for detecting the next information and going ahead with synthesization of the next word is similar to the operation in which the number of a word is externally designated and the synthesizer is actuated. FIG. 10 shows a modified version of FIG. 1 wherein the same functions are represented with the same interrelated construction, with the exception that the synthesizer of FIG. 10 includes a word control memory 153 storing data as described in relationship to the word control memory 103 of FIG. 9. Additionally, a selector 165 selects the word No. in the word designator 151. The next information from the word control memory 103,153 after the word has been synthesized, is inputted to the selector 165 by means of a bus 164, which then selects the desired following word No. in the word designator. It should be noted that the selector 165 designates the next word in response either to the "next information" data from the word control memory 153, or in reponse to an external input on the line 156 which corresponds with the input line 6 of FIG. 1. Relative to the hardware construction of the overall synthesizer, the addition of the selector 165 is minor.

As described above, addition of a small amount of hardware makes it possible to easily connect words in the speech synthesizer. This alternative embodiment of a speech synthesizer in accordance with this invention is especially useful and advantageous in applications where there are relatively many words which can be shared in several sentences or which are used repetitively in the same sentence which is to be synthesized. This is especially valuable where a controller such as a CPU is too expensive for the application, for example, speech synthesizers in simple talking toys. More sentences can be generated extending over longer intervals of time by interconnecting stored words such that they may be used repetitively in the same or different messages. Thus, the words are not always synthesized from the data in the order in which they are stored in the data. Longer intervals of speech are possible with the same memory capacity.

As previously stated, one speech synthesizing system which has been embodied in integrated circuits and put to use, is a system of linear predictive coding synthesis. In such a system, speech is analyzed by a separate computer to obtain R parameters and sound origin parameters which are stored in a read-only memory in the speech synthesizer. For synthesizing speech, these two kinds of speech synthesizing parameters are read out, their products are summed by a lattice-type digit filter, and the result is subjected to digital/analog conversion before synthesized speech is generated. When a system of linear predictive coding synthesis is used, a speech parameter memory of at least 1200–2400 bits is sufficient for generating synthesized speech for a period of time of one second. The number of bits is compressed into 1/30 of that (64 kilobits/second) required of an ordinary PCM system. Hardware necessary for a linear predictive coding synthesis system should include lattice-type digital filters of about ten stages, a logic construction for driving a source of sound, the waveform of the voiced sound at the sound origin, a digital/analog converter, a logic construction for inserting parameters, and a clock generator. Such a construction when integrated occupies a chip of the size of 0.5–1 $cm^2$. In particular, ten stages of lattice-type digital filters take up an area of 3 $mm^2$ or more under the present state of the art. It is customary to use a processor, such as a general purpose four bit or eight bit processor, for controlling the speech generator and the read-only memory storing the parameters. Thus, the system of linear predictive coding synthesis has a rate of compression which is much higher than that of a PCM system, but on the other hand, complex hardware is required and this is burdensome.

For generating synthesized speech over extended periods of time, that is, lengthy discourse, the linear predictive coding synthesis system with a high rate of compression is advantageous because of its small read-only memory capacity requirements. However, for applications where the speech which is generated is only for a short time period, the hardware is burdensome in view of the task to be accomplished. For speech syntheis of short intervals a method of compilation of speech phonemes is advantageous.

The method of compilation of the speech phonemes is such that representative speech elements are picked up in pitches as voiced phonemes from human natural speech. Speech elements with no periodicity are picked up as voiceless phonemes for fixed time intervals from human natural speech. The phonemes are read out in accordance with information applied at the time of storage of the phoneme data and put together for synthesizing speech. With this phoneme construction, the speech desired to be generated is analyzed in advance to provide control parameters such as information as to whether the phoneme is voiced or voiceless, the identification number of the phonemes, amplitudes, pitches, repetition numbers (especially important in relation to voiceless phonemes), and time-sequence waveforms which serve as phonemes. The control parameters of the waveforms are stored as digital information in the memories. The phonemes are successively read out in accordance with the control parameters, and the amplitude, pitch, repetition number, etc., are applied to bring the phonemes together in proper format. The phonemes are then processed through a digital-analog converter for generating synthesized speech which is outputted from a loudspeaker.

Generation of synthesized speech for a second requires approximately several to ten kilobits, which in storage undergo a rate of compression several times poorer than the compression used in the linear predictive system. However, in the phoneme system, waveforms are directly connected together in time sequence for speech synthesis. No mathematical processing such as computer parameters is required and accordingly, circuitry such as lattice-type digital filters is unnecessary. Thus, a LSI for the construction using a compilation of speech phonemes in accordance with this invention has a poorer rate of compression for data stored in the memories than that of a LSI for a linear predictive coding system, but, the speech synthesizer relying on phonemes in accordance with this invention requires only a small amount of hardware as compared to the linear predictive coding system. This is advantageous for applications in which speech is synthesized for a short interval of time, e.g., a speaking toy, and the quantity of data which must be stored in memory is relatively small.

A problem arises in the production of speech synthesizers for messages of short time interval. In particular, a large proliferation of different messages are required and accordingly, only small production runs are required for each of the different messages to be synthesized. Accordingly, where read-only memories are utilized as described above, production costs and shipping costs are high as compared to items produced and shipped in large scale mass production. It is desirable that the synthesizer be constructed on a single chip. Accordingly, the most effective speech synthesizing LSI preferably has the following features for manufacturers. (1) The LSIs should be manufactured without discrimination between them, even though they are intended ultimately for different speech contents. (2) The addition of the speech content data to a basic chip should occur as late as possible in the stages of the manufacturing process. Thus, requirements for any speech content made by the customer and special orders, can be speedily satisfied.

From the consumer or customer's point of view, there are the following requirements. (3) There should be a large selection of speech content available. (4) LSIs should be available having a standardized word content in addition to a portion which is specially tailored to the individual consumer's need. Thus, many different kinds of LSIs should be available, even though in small quantities, with low cost and with short delivery times. (5) It is desirable that the speech contents of the LSIs can be modified up to the point where the LSIs are about to be delivered to the market.

Speech synthesizing LSIs heretofore have used mask ROMs. The mask ROMs are prepared by replacing one or a plurality of masks ordinarily used with masks for distributing aluminum wire and masks for controlling diffusion layers in the manufacturing process of the LSIs. Therefore, the LSIs of different speech content are distinquished at the stage of designing the mask for the ROMs. No correction of speech content can be made to the LSI upon completion of the chip. Correction to the speech content requires correction and reproduction of the masks. LSIs which contain non-usable speech contents either through error or change in the required speech content must be discarded. There are as many masks required as there are kinds of speech contents. Hence, it is difficult to reduce production costs for the LSIs when there are so many different kinds of speech and the production quantities are small. As a result, the requirements 3,4 and 5 described above cannot be readily satisfied for the benefit of the consumer.

Figure 11:
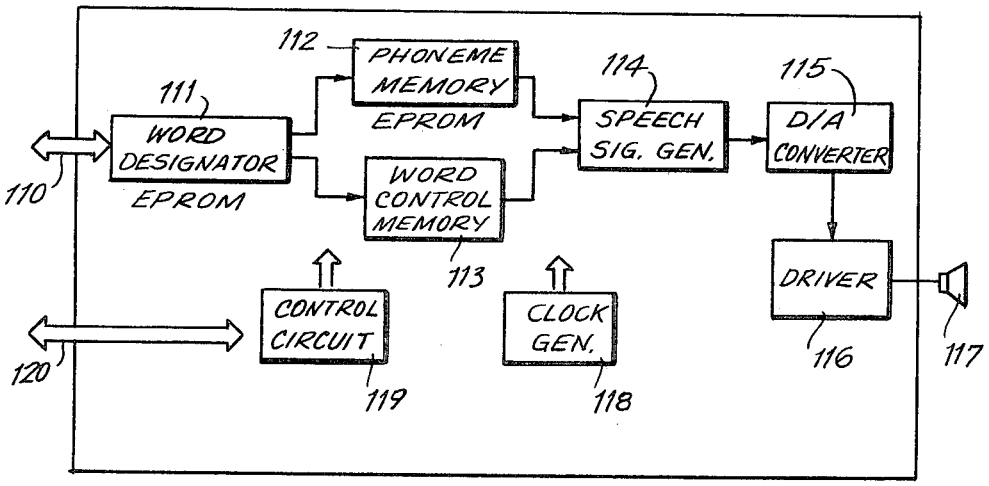
FIG. 11 is a functional block diagram of a LSI including a synthesizer similar to FIG. 1.

The embodiments in accordance with this invention as described above, use ROMs and suffer from the production and cost inefficiencies already described. In an alternative embodiment of a speech synthesizer in accordance with this invention, the foregoing defficiencies of a synthesizer LSI using ROMs are eliminated and the requirements of both the manufacturer and consumer are satisfied. In this alternative embodiment (FIG. 11), the hardware which varies with speech content is comprised of an erasable programmable read-only memory (EPROM). FIG. 11 shows a block diagram of a speech synthesizer LSI which, as described above, operates on the method of compilation of speech phonemes and which can be contained on a LSI chip within a single frame. As before, speech which is to be generated is analyzed to provide control parameters indicating whether a phoneme is voiced or voiceless, identification numbers of phonemes, amplitudes, pitches, and repitition numbers, etc. These control parameters are stored as digital information in a word control information storage EPROM 113. Digital information, as before, of time sequence waveforms serve as phonemes and are stored in phoneme memory 112, also including an EPROM. A word designator 111 for selecting the addresses in the two storage EPROMS 112,113 also includes an EPROM.

The circuit construction represented in FIG. 11 is similar to that shown in FIGS. 1–10. For speech generation, a word is designated in the word designator 111 which selects the addresses in the word control 113 and phoneme memory 112 in accordance with a selecting address signal present on the input line 110. The selected phonemes are joined together in a synthesizing circuit 114 and the digital output is put through a digital-analog converter 115 to provide analog signals, that is, synthesized speech waveforms, which drive a loudspeaker 17 through a loudspeaker driver 116 to generate the desired audible synthesized speech.

Hardware portions which vary in manufacture as the different speech contents are varied are those elements which store the word designating information, that is, the word designator 111, control parameters, that is, the word control memory 113, and digital information on phoneme waveforms, that is, the phoneme memory 112. These elements differ from the constructions of FIG. 1–10 in that erasable programmable read-only memories are used in the construction of FIG. 11 whereas ROMS were used in the previous constructions. As a result, the requirements of both the manufacturer and the consumer are satisfied for flexibility in producing small lots at low costs of a plurality of LSIs having different speech contents. The EPROM is characterized in that data is written into memory after the manufacturing process is completed. Additionally, data can easily be written, erased, and written again by a ROM writer at the manufacturer's facility. An EPROM with 16–32 kilobits is a practicable application as represented by the Intel 27 Series manufactured by the Intel Corporation. Thus, an embodiment of a speech synthesizer in accordance with this invention as illustrated in FIG. 11 is technically achievable. The LSI includes a clock generator circuit 118 and control circuits 119,120 which perform the functions indicated in the previous Figures for actuation of the synthesizer, indicating the end of synthesis, and for carrying out programs as indicated in FIGS. 9 and 10.

It will thus be seen that the objects set forth above, among these made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A speech synethesizer for producing speech by connecting phonemes together, comprising:

phoneme memory means, said phoneme memory means containing an ordered arrangement of data storage regions of equal and fixed capacity, each said region storing data representative of one of voiced and voiceless phonemes, said data being stored in said ordered arrangement in the sequence of occurrence of said phonemes in natural speech;

word control memory, said word control memory storing groups of control information necessary for synthesizing sound from said stored phoneme data, particular control information being provided to said phoneme memory means to regulate the synthesizing of phoneme data from each said data region, each said group of control information including at least amplitude, pitch and repetition information;

speech generator, said generator receiving phoneme data from said phoneme memory means in a phoneme data sequence controlled by said control memory information and outputting audible signals; and a word designator, said word designator selecting a first region in said phoneme memory means to provide first phoneme data to said speech generator, and selecting a first group of controlled information from said word control memory to regulate said phoneme memory means in the synthesization of a speech signal from said first phoneme data, said first region storing phoneme data of the initial portion of the synthesized audible output.

2. A speech synthesizer as claimed in claim 1, and further comprising means to automatically fetch phoneme data successively from successive data storage regions in said phoneme memory means, thereby producing connected phonemes, that is, words, said word control memory being adapted to provide successive particular controlled information associated with each said synthesized phoneme.

3. A speech synthesizer as claimed in claim 2, wherein said control information includes an end instruction, the occurrence of said end instruction causing said automatic successive synthesization of phonemes to stop.

4. A speech synthesizer as claimed in claim 2 or 3, wherein said groups of control information are arranged in an ordered sequence.

5. A speech synthesizer as claimed in claim 4, wherein said word control memory is adapted to successively apply a plurality of groups of control information in said ordered sequence of information to the data in the same phoneme memory storage region, at least said pitch information being subject to variation among said plurality of group, intonation of the produced audible phoneme varied by varying the pitch.

6. A speech synthesizer as claimed in claim 1 or 2, and further comprising input means for triggering said synthesizer to provide an output, said input means when actuated, being adapted to apply a start signal to said word designator, said designator being adapted to select said first region upon the occurrence of said start signal.

7. A speech synthesizer as claimed in claim 6, wherein said input means is actuatable by any of a plurality of discrete input signals, each descrete input signal causing said designator to initiate successive phoneme synthesization at a different region in said phoneme memory means.

8. A speech synthesizer as claimed in claim 7, wherein said input means is actuatable by either one of an internally and externally generated signal.

9. A speech synthesizer as claimed in claim 8, wherein said internally generated signal is controlled by said control information in said control memory, whereby said word designator selects phoneme regions for synthesization in any sequence in response to said control information and the same words may occur more than once in a sentence by using the same phoneme data.

10. A speech synthesizer as claimed in claim 2, and further comprising clock means for timing the output of data from said phoneme memory storage regions, said output being at a regular rate based upon the occurrence of clock signals, the pitch, that is, the time interval between successively synthesized phonemes, being controllable in response to said information in said word control memory, each synthesized phoneme sound including less than, an amount equal to, or more than the total data stored in the associated phoneme region, the pitch of each synthesized phoneme sound depending upon the pitch interval assigned to said synthesized phoneme by the associated group of control information, whereby a phoneme can be synthesized with selected tones.

11. The speech synthesizer as claimed in claim 10, wherein when the synthesized phoneme includes data exceeding the stored phoneme data, the interval following the stored data synthesized output includes an added signal for the remainder of the pitch interval.

12. The speech synthesizer as claimed in claim 11, wherein said added signal is a zero level signal.

13. The speech synthesizer as claimed in claim 10 or 11 wherein when the synthesized phoneme includes data less than the stored phoneme data, the trailing end of the phoneme is cut off and the phoneme data for said trailing end is not synthesized.

14. The speech synthesizer as claimed in claim 2 or 10, wherein said phoneme memory means includes a phoneme number counter for designating said phoneme storage regions, and an address counter for designating with each count a position of a phoneme data point in said phoneme region, said address counter being capable of counting consecutively to a greater number that the number of said phoneme data points in the region, a fixed signal being output from said phoneme memory means and synthesized when said address count exceeds the number of said data points in the phoneme memory storage regions.

15. The speech synthesizer as claimed in claim 2, wherein said equal and fixed phoneme memory regions can contain a fixed quantity of bits, a stored voiced phoneme having each data point represented by a first number of bits, whereby the number of voiced data points in a phonome region is fixed, a stored voiceless phoneme having each data point represented by a second number of bits, said second number of bits being one half or less than said first number of bits, whereby the number of voiceless data points in a phoneme region can exceed the number of voiced data points in a phoneme region.

16. The speech synthesizer as claimed in claim 15, and further comprising multiplexer means for individually reading out of said phoneme memory storage region said data points having said second number of bits.

17. The speech synthesizer as claimed in claim 2, wherein said control information includes a next word instruction, the occurrence of said next word instruction causing said automatic successive synthesization of phonemes to continue with the start of another word, said next word being designated by said control information.

18. The speech synthesizer as claimed in claim 17, wherein said control information further includes an end instruction, the occurrence of said end instruction causing said automatic successive synthesization of phonemes to stop, whereby a plurality of outputs can be synthesized by using stored phoneme data in any required sequence.

19. The speech synthesizer as claimed in claim 2, wherein said phoneme memory, means word control memory and word designator each include a EPROM.

20. A speech synthesizer as claimed in claim 2, wherein said phoneme data is stored in digital bits, said speech generator being adapted to convert the digital output of said phoneme memory to an analog signal.

* * * * *